United States Patent [19]

Hashimoto

[11] 4,414,503

[45] Nov. 8, 1983

[54] LOW VOLTAGE REGULATION CIRCUIT

[75] Inventor: Masami Hashimoto, Suwa, Japan

[73] Assignee: Kabushiki Kaisha Suwa Seikosha, Tokyo, Japan

[21] Appl. No.: 328,348

[22] Filed: Dec. 7, 1981

[30] Foreign Application Priority Data

Dec. 10, 1980 [JP] Japan ..... 55-174162
Sep. 4, 1981 [JP] Japan ..... 56-139548

[51] Int. Cl.[3] ..... G05F 3/08
[52] U.S. Cl. ..... 323/315; 307/297
[58] Field of Search ..... 307/297, 304; 323/312, 323/313, 315, 316

[56] References Cited

U.S. PATENT DOCUMENTS 3,823,332 7/1974 Feryszka et al. ..... 323/313 X
4,100,437 7/1978 Hoff, Jr. ..... 307/297
4,300,091 11/1981 Schade, Jr. ..... 307/297 X
4,327,321 4/1982 Suzuki et al. ..... 323/315
4,361,797 11/1982 Kojima et al. ..... 307/297 X

*Primary Examiner*—William M. Shoop
*Attorney, Agent, or Firm*—Blum, Kaplan, Friedman, Silberman & Beran

[57] ABSTRACT

A low voltage regulation circuit especially suitable for supplying current to high frequency loads is provided. The circuit comprises two P channel MOSFETs having the same threshold voltage and two N channel MOSFETs having repsectively different threshold voltages. The difference between the threshold voltages of the two N channel MOSFETs is provided as a constant output from the circuit, and load current is supplied from the output terminal. Circuit construction is simplified such that a low voltage regulation circuit with a small pattern area on the integrated circuit is obtained.

19 Claims, 6 Drawing Figures

FIG. 1
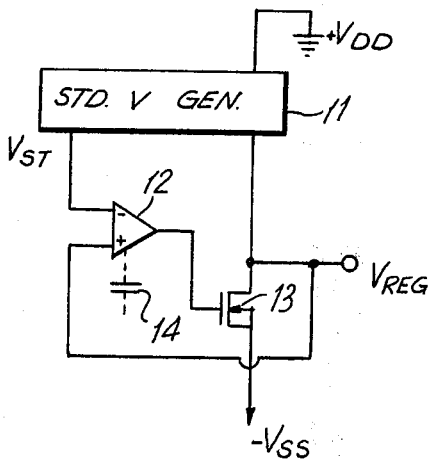
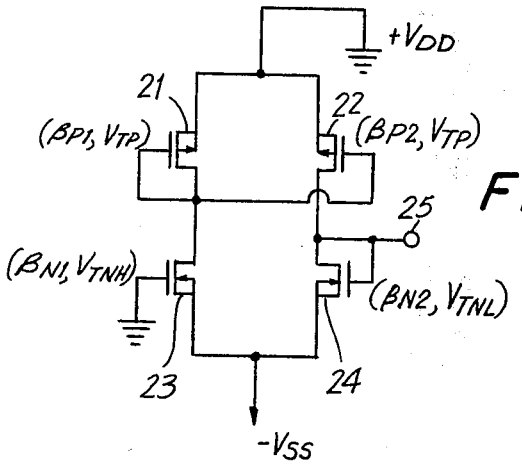
FIG. 2
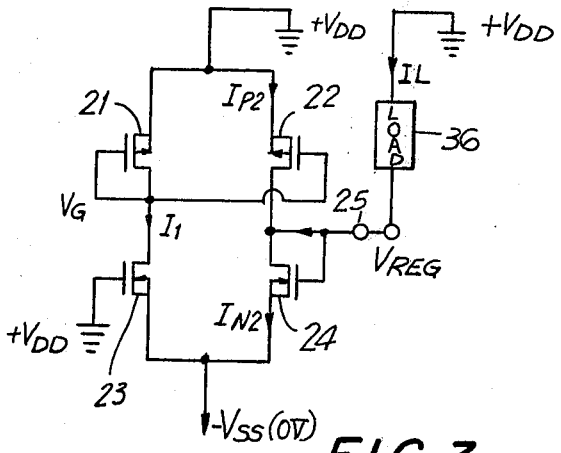
FIG. 3

FIG. 4
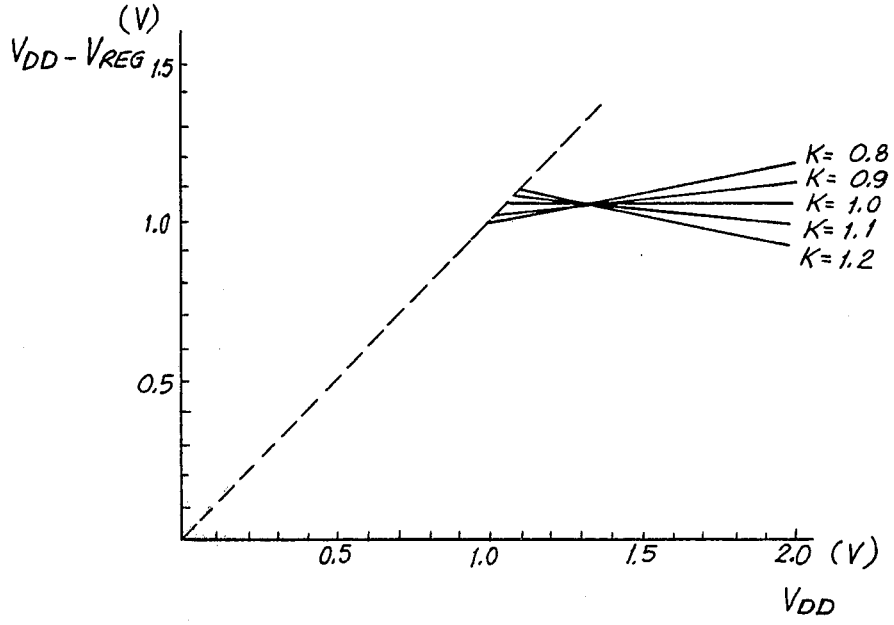
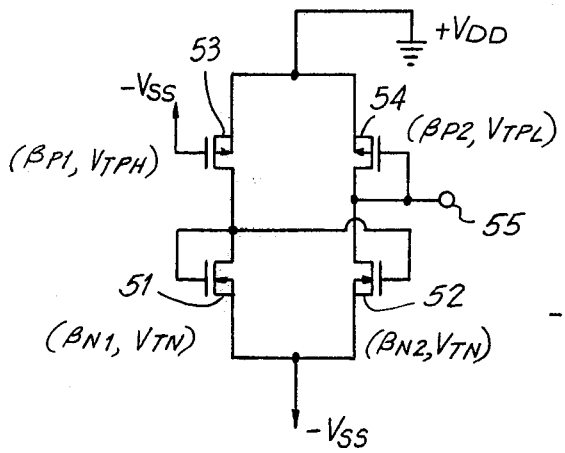
FIG. 5
FIG. 6
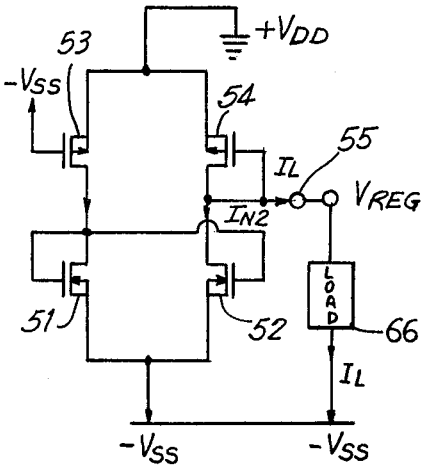

LOW VOLTAGE REGULATION CIRCUIT

BACKGROUND OF THE INVENTION

This invention relates generally to a voltage regulation circuit for use with integrated circuits and more particularly to a low voltage regulation circuit intened to reduce the power consumption and current of an integrated circuit. In earlier low voltage regulation circuits, the sum of the threshold voltage VTP of a P channel transistor and the threshold voltage VTN of a N channel transistor, that is, a voltage having a value of VTP+VTN is provided. The voltage is controlled by a comparator in order to make the supply voltage of circuits operating with high frequency, for example, an oscillation circuit, flip-flops, equal with the magnitude VTP+VTN. However, such a circuit has a disadvantage in that a large pattern area is required in the integrated circuit because of the standard voltage circuit (VTP+VTN), the comparator, a capacitor for preventing oscillation of the comparator, and the like. The large surface area required for the standardized voltage circuit is very disadvantageous in view of a purpose of reducing voltage, that is, to reduce the size of the integrated circuit chips. Additionally, the large pattern area increases the cost of manufacture.

What is needed is a low voltage regulation circuit which is simplified in construction and requires a reduced pattern area in the integrated circuit.

SUMMARY OF THE INVENTION

Generally speaking, in accordance with the invention, a low voltage regulation circuit especially suitable for supplying current to high frequency loads is provided. The circuit comprises two P channel MOSFETs having the same threshold voltage and two N channel MOSFETs having respectively different threshold voltages. The difference between the threshold voltages of the two N channel MOSFETs is provided as a constant output from the circuit, and load current is supplied from the output terminal. Circuit construction is simplified such that a low voltage regulation circuit with a small pattern area on the integrated circuit is obtained.

Accordingly, it is an object of this invention to provide an improved low voltage regulation circuit which requires only a small pattern area in an integrated circuit construction.

Another object of this invention is to provide an improved low voltage regulation circuit which provides load current from the constant voltage output terminal.

A further object of this invention is to provide an improved low voltage regulation circuit which has a highly stable output over a wide range of source voltage values.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a circuit diagram of a conventional low voltage regulation circuit;

FIG. 2 is a circuit diagram of a low voltage regulation circuit in accordance with the invention;

FIG. 3 is a circuit similar to that of FIG. 2 showing a connected load and indicating current flows;

FIG. 4 is the output voltage characteristics of the low voltage regulation circuit of FIGS. 2 and 3;

FIG. 5 is an alternative embodiment of a low voltage regulation circuit in accordance with the invention; and FIG. 6 is a circuit similar to the circuit of FIG. 5 showing a connected load and indicating current flows.

DESCRIPTION OF THE PREFERRED EMBODIMENTS

This invention describes a low voltage regulation circuit of a monolithic MOS integrated circuit design.

FIG. 1 illustrates a conventional, earlier low voltage regulation circuit comprising a standard voltage generation circuit 11, an operational amplifier 12 and a MOSFET 13. The circuit operates by utilizing the variations of the equivalent resistance of the MOSFET 13 by controlling the potential applied to the gate of the MOSFET 13. A low voltage regulation circuit is achieved by the following procedure wherein the standard voltage output Vst from the standard voltage generation circuit 11, and the output voltage Vreg from the low voltage regulation circuit are both input to terminals of the operational amplifier 12. The output of the operational amplifier 12 controls the gate of the MOSFET channel transistor 13 varying the equivalent resistance thereof such that the output voltage Vreg is made equal to the standard voltage Vst.

However, such a circuit requires a large pattern area on an integrated circuit because of the large number of elements comprising the circuit as shown in FIG. 1. Further, a capacitor 14 for preventing oscillation of the operational amplifier 12, is also a requirement. This is very disadvantageous from the viewpoint of a purpose to reduce the size of the integrated circuit chip.

A circuit construction of a low voltage regulation circuit in accordance with this invention is described with reference to FIG. 2. The source and the substrate of P channel MOSFETs 21, 22 are connected to a voltage supply +VDD. The source and the substrate of N channel MOSFETs 23, 24 are connected to the negative terminal −VSS of the power supply. The gate and the drain of the P channel MOSFET 21 are connected together. The gate of the P channel MOSFET 22 is connected to the gate of the P channel MOSFET 21.

The gate of N channel MOSFET 23 is connected to the positive terminal +VDD and the gate and drain of the N channel MOSFET 24 are connected together. The drain of the P channel MOSFET 21 is connected to the drain of the N channel MOSFET 23. The drain of the P channel MOSFET 22 is connected to the drain of the N channel MOSFET 24, and this circuit point is an output terminal 25 at a regulated voltage.

$\beta$ of P channel MOSFET 21 is indicated as $\beta$P1, and the threshold voltage is VTP. $\beta$ of the P channel MOSFET 22 is indicated by $\beta$P2, and the threshold voltage is VTP. $\beta$ of the N channel MOSFET 23 is indicated by $\beta$N1, and the threshold voltage in VTNH. $\beta$ of N channel MOSFET 24 is indicated by $\beta$N2, and the threshold voltage is VTNL.

Operation of the circuit of FIG. 2 is now explained with reference to FIG. 3 where a load 36 is applied and current flows are indicated. Because both P channel MOSFETs 21, 22 operate in the saturation region, and have a common gate potential, the ratio of the current flowing in the P channel MOSFET 21 to the current flowing in the P channel MOSFET 22 is equal to the ratio of $\beta$P1 to $\beta$P2. The current flowing in the P channel MOSFET 21 is equal to the current flowing in the N channel MOSFET 23 since their sources and drains are connected in series. The current flowing in the P channel MOSFET 22 has a particular relationship to the current flowing in the N channel MOSFET 24. Also, the current flowing in the N channel MOSFET 24 has a particular relationship to the potential at the output terminal 25. In particular, the potential at the output terminal 25 is related to all of the MOSFETs 21-24. The higher is the threshold of voltage VTNH of the N channel MOSFET 23, the less is the current flowing through the MOSFETs 21,23, and also in the P channel MOSFET 22.

As the current IP2 flowing in the P channel MOSFET 22 is reduced, the potential at the output terminal 25 becomes closer to the potential at the terminal −VSS. Further, when the threshold voltage VTNL of the N channel MOSFET 24 is lower, the potential at the output terminal 25 becomes close to the potential of the negative terminal −VSS. Therefore, when providing $\beta$P1, $\beta$P2, $\beta$N1 and $\beta$N2 with suitable values in design, there is the possibility to output a voltage of the value VTNH-VTNL at the output terminal 25 with this voltage value remaining substantially constant and unrelated to the supply voltage VDD-VSS. It is practically possible to output such a constant voltage.

The operating principles of the low voltage regulation circuit in accordance with this invention are described above with reference to FIGS. 2, 3. Operation of each MOSFET is now described simply again. The P channel MOSFETs 21,22 served to connect the current flow in each circuit element including MOSFETs 21, 22. The N channel MOSFET 23 operates to provide the higher threshold voltage VTNH, whereas the N channel MOSFET 24 operates to provide the lower threshold voltage VTNL. In the design procedures, the values of $\beta$P1, $\beta$P2, $\beta$N1 and $\beta$N2 are selected for the most suitable value for the estimated value of load current which is to be drawn.

It is necessary to design the MOSFETs 21-24 so as to operate in the saturation region. The conditions necessary to meet these requirements are defined in the unequal expressions 101, 102 as described hereinafter. Operation of the circuit of FIG. 3 is explained in more detail by the following equations. Current $I_1$ flows in the P channel MOSFET 21 and the N channel MOSFET 23 in series. Current IP2 flows in the P channel MOSFET 22. Current IN2 flows in the N channel MOSFET 24. The load 36 draws a load current IL. The potential of the drain of the P channel MOSFET 21 is indicated by VG and the potential −VSS is set at zero. The potential of the drain of the P channel MOSFET 22, that is, at the output 25 of this low voltage regulation circuit is indicated as Vreg. $\beta$P1, $\beta$N1, VDD, VTNH, VTNL and VTP are given values to satisfy the following inequalities.

$$\frac{VTNH - VTNL}{VDD - VTNH} > \sqrt{\frac{\beta N1}{\beta P1}} \tag{101}$$

and $$\frac{VTNH - VTP}{VDD - VTNH} > \sqrt{\frac{\beta N1}{\beta P1}} \tag{102}$$

whereby the following equations are obtained:

$$I_1 = \tfrac{1}{2}\beta P1(VDD - VG - VTP)^2 \tag{103}$$

$$I_1 = \tfrac{1}{2}\beta N1(VDD - VTNH)^2 \tag{104}$$

$$IP2 = \tfrac{1}{2}\beta P2(VDD - VG - VTP)^2 \tag{105}$$

$$IN2 = \tfrac{1}{2}\beta N2(Vreg - VTNL)^2 \tag{106}$$

$$IP2 + IL = IN2 \tag{107}$$

Also, the relationship between the load current IL and the current through the P channel transistor 22 is defined as flollows:

$$IL = nIP2 \tag{108}$$

Simultaneous solution of the equations (103) to (108) brings about the following relationship:

$$Vreg = VTHL + K(VDD - VTNH) \tag{109}$$

$$K = \sqrt{\frac{(n+1)\beta N1 \cdot \beta P2}{\beta N2 \cdot \beta P1}} \tag{110}$$

The characteristics $\beta$P1, $\beta$P2, $\beta$N1 and $\beta$N2 are given values such as to make $$K = 1 \tag{111}$$

thereby the following result is obtained.

$$VDD - Vreg = VTNH - VTNL \tag{112}$$

Accordingly, it is found from equation (112) that when the circuit elements are designed to satisfy each of the conditional equations (101), (102) and (111), the regulated low voltage (VTNH−VTNL) is obtained between the output terminal 25 and the positive supply terminal +VDD. With regard to equation (108), when load current IL varies due to variations in the manufacturing process or in the usage of the integrated circuit, there is the danger that the condition K=1 is not maintained and the output voltage varies.

An example for estimating with numerical values the voltage characteristic in the above described case, is indicated in FIG. 4.

$$VTNH = 1.35[V]$$

$$VTNL = 0.30[V]$$

$$VTP = 0.5[V]$$

$$n = 12(K = 1)$$

In this embodiment, the following conditions are given wherein the output variations are in accordance with the increase and decrease of IL which can be regarded as resulting from a variation in the value of n and K. K is used as a parameter in FIG. 4. As shown in FIG. 4, when using a silver oxide battery having a voltage VDD of approximately 1.55 volts as a current source, the variation of the output voltage of the low voltage regulation circuit is always within ±0.05 volts in spite of variations in K in a range of K=0.8 through K=1.2. Therefore, the low voltage regulation circuit in accordance with the invention can be put to practical use. The variation of load current IL corresponding to a range of K=0.8 through K=1.2 is approximately 64% to 144%.

FIG. 5 is the circuit of an alternative embodiment of a low voltage regulation circuit in accordance with the invention. In the embodiment of FIG. 5, the P channel MOSFETs are exchanged for the N channel MOSFETs of FIG. 3. The relationship between the MOSFETs of FIGS. 3, 5 is as follows:

| FIG. 3 | is changed to → | FIG. 5. |
|---|---|---|
| *P* channel MOSFET 21 | → | *N* channel MOSFET 51 |
| *P* channel MOSFET 22 | → | *N* channel MOSFET 52 |
| *N* channel MOSFET 23 | → | *P* channel MOSFET 53 |
| *N* channel MOSFET 24 | → | *P* channel MOSFET 54 |

The circuits of FIGS. 5 and 6 are designed so as to satisfy the following equations:

$$\frac{VTPH - VTPL}{VDD - VTPH} > \sqrt{\frac{\beta P1}{\beta N1}} \quad (113)$$

$$\frac{VTPH - VTN}{VDD - VTPH} > \sqrt{\frac{\beta P1}{\beta N1}} \quad (114)$$

$$IL = nIN2 \quad (115)$$

$$K = \sqrt{\frac{(n+1)\beta N2 \cdot \beta P1}{\beta N1 \cdot \beta P2}} \quad (116)$$

$$K = 1 \quad (117)$$

The following relationship results.

$$Vreg = VTPH - VTPL \quad (118)$$

As a result, a regulated low voltage VTPH−VTPL is obtained between the output terminal 55 and the negative source terminal −VSS. Performance characteristics similar to FIG. 4 are obtained.

It will thus been seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limited sense.

It is also to be understood that the following claims are intended to cover all of the generic and specific features of the invention herein described, and all statements of the scope of the invention which, as a matter of language, might be said to fall therebetween.

What is claimed is:

1. A low voltage regulation circuit comprising:

a power supply having a positive and a negative terminal;

a first and second branch circuit in parallel across said power supply, each said branch circuit including a N channel and a P channel transistor with source/drains in series, the channel transistors of one conductivity type having different threshold voltages, the channel transistors of the other conductivity type having the same threshold voltages;

a load terminal, said load terminal being connected in circuit with said parallel branch circuits and being adapted for connection with one end of a load, load current flowing from said load terminal through said connected load when the other end of said load connects to one said terminal of said power supply, the voltage between said load terminal and said one power supply terminal being the difference in threshold voltages of said one conductivity type of channel transistors.

2. A low voltage regulation circuit as claimed in claim 1, wherein said load terminal is connected at a point between the two transistors in said second branch circuit.

3. A low voltage regulation circuit as claimed in claim 2, wherein said load current also flows through at least one of said transistors.

4. A low voltage regulation circuit as claimed in claim 3, wherein the transistor of the one conductivity type in said second branch circuit has the lower threshold voltage of the two transistors of said one conductivity type.

5. A low voltage regulation circuit as claimed in claim 4, wherein said load current flows through said transistor with the lower threshold voltage.

6. A low voltage regulation circuit as claimed in claim 3 or 5, wherein the sources of said one conductivity type are connected together.

7. A low voltage regulation circuit as claimed in claim 6, wherein the sources of said other conductivity type are connected together.

8. A low voltage regulation circuit as claimed in claim 7, wherein the drains of said series transistors in each of said branch circuit are connected together.

9. A low voltage regulation circuit as claimed in claim 8, wherein the sources of said other type transistor and said other end of said load connect to the same one terminal of said power supply.

10. A low voltage regulation circuit as claimed in claim 9, wherein said one conductivity type transistor is a N-type transistor and the other conductivity type is a P-type transistor.

11. A low voltage regulation circuit as claimed in claim 10, wherein said sources of said P-type transistors and said one end of said load are connected to the positive terminal of said power supply.

12. A low voltage regulation circuit as claimed in claim 11, wherein the gates of said P-type transistors connect together and to the drain of said P-type transistor of said first branch circuit.

13. A low voltage regulation circuit as claimed in claim 12, wherein the gate of said N-type transistor of said first branch circuit connects to said positive terminal and the gate of said N-type transistor of said second branch circuit connects to said load terminal.

14. A low voltage regulation circuit as claimed in claim 10, wherein the threshold voltages VTNH, VTNL, VTP of said transistors and the voltage VDD of said power supply satisfy relationships as follows:

$$\frac{VTNH - VTNL}{VDD - VTNH} > \sqrt{\frac{\beta N1}{\beta P1}}$$

and $$\frac{VTNH - VTP}{VDD - VTNH} > \sqrt{\frac{\beta N1}{\beta P1}}.$$

15. A low voltage regulation circuit as claimed in claim 9, wherein said one conductivity type transistor is a P-type transistor and the other conductivity type is a N-type transistor.

16. A low voltage regulation circuit as claimed in claim 15, wherein said sources of said N-type transistors and said one end of said load connect to the negative terminal of said power supply.

17. A low voltage regulation circuit as claimed in claim 16, wherein the gates of said N-type transistors connect together and to the drain of said N-type transistor of said first branch circuit.

18. A low voltage regulation circuit as claimed in claim 17, wherein the gate of said P-type transistor of said first branch circuit connects to said negative terminal, and the gate of said P-type transistor of said second branch connects to said load terminal.

19. A low voltage regulation circuit as claimed in claim 18, wherein the threshold voltages VTPH,VTPL,VTN of said transistors and the voltage VDD of said power supply satisfy the relationships as follows:

$$\frac{VTPH - VTPL}{VDD - VTPH} > \sqrt{\frac{\beta P1}{\beta N1}}$$

$$\frac{VTPH - VTN}{VDD - VTPH} > \sqrt{\frac{\beta P1}{\beta N1}}.$$

* * * * *